US005197240A

United States Patent [19]

Eryou

[11] Patent Number: 5,197,240

[45] Date of Patent: Mar. 30, 1993

[54] TRANSFER PAD COVER

[76] Inventor: N. Dennis Eryou, 8 Ivy Pl., Huntington, N.Y. 11743

[21] Appl. No.: 764,446

[22] Filed: Sep. 24, 1991

[51] Int. Cl.[5] ..... E04B 1/343

[52] U.S. Cl. ..... 52/66; 49/33; 137/234.6; 135/87; 52/64; 52/66

[58] Field of Search ..... 52/64, 66; 135/87, 88, 135/96, 908; 160/7, 371; 49/33; 137/234.6; 220/565

[56] References Cited

U.S. PATENT DOCUMENTS 2,848,722 8/1958 Choporis ..... 49/33

4,960,150 10/1990 Ryan ..... 137/234.6

*Primary Examiner*—Richard E. Chilcot, Jr.

*Assistant Examiner*—Matthew E. Leno

*Attorney, Agent, or Firm*—Darby & Darby

[57] ABSTRACT

A transfer pad cover includes a frame structure covered by a water-proof sheet material. The frame structure is supported by bar joists that are mounted for movement along tracks. The entire structure is moved by hand or motor or by a truck from which a liquid transfer will be made to a position adjacent the transfer pad during the transfer operation. When the material and frame structure are sufficiently weighted down so that it is unsafe to move the cover, the joists will rest on a ground surface, preventing movement of the cover. In an alternate embodiment, the rails are sloped and the truck pushes the cover off of the pad. When the truck leaves the pad, the slope of the rails causes the cover to automatically return to protect the pad under the influence of gravity.

15 Claims, 3 Drawing Sheets

TRANSFER PAD COVER

FIELD OF THE INVENTION

This invention relates to ground covering structures. More specifically, this invention relates to a structure that covers a truck transfer pad and protects the pad from precipitation when the pad is not in use.

BACKGROUND OF THE INVENTION

As environmental concerns become increasingly prevalent in all aspects of industrial and consumer life, the practical and financial demands placed on businesses by strict regulatory standards have skyrocketed. In perhaps no other industry has this been more apparent than in the handling and disposal of regulated materials, such as hazardous wastes and petroleum products. The procedures for containing, transporting, and disposing these materials have become a conglomerate of regulations and standards. Conforming to these standards, while maintaining cost-efficiency and productivity can mean the difference between profitability and failure.

One segment of the industry with a particular set of environmental concerns is the transportation of liquid products. These products may include liquids with high heavy metal concentrations, petroleum products, or other liquids deemed to be dangerous should they be released into the environment or water supply. Tank trucks have proved effective for safely transporting many of these liquids, but problems can arise in transferring the liquids to and from the trucks, such as spills or leaks. Some dry chemicals, such as powdered agricultural chemicals are often transported similarly.

A known solution to this problem is to construct a transfer pad on which the trucks can safely transfer the materials. The transfer pad generally has a slight bowl-like shape, with a gently sloping basin floor leading toward a central sump area. Should any material be spilled during the transfer process, it will be retained in the sump until it can be disposed of properly, such as by being vacuumed out and further transported by truck to a disposal site. Obviously, the pad is formed from a material that is impervious to the liquid being transferred, such as asphalt, concrete or coated concrete.

However, in solving the transfer spill problem, another has arisen with respect to these transfer pads, namely, the accumulation of precipitation. Since a small amount of waste material is retained on the pad or held in the sump, any rainfall or melted snow accumulating on the pad or sump becomes immediately contaminated, and must be disposed of as contaminated waste. At current liquid disposal costs of approximately one dollar per gallon, transporting accumulated rainwater can add up to thousands of dollars per year for a single pad. Worse yet, unexpectedly heavy rainfall might cause the sump to overflow, carrying the regulated products into the neighboring ground areas.

This concern can be met by covering the pad with a roofed building or a canopy. Unfortunately, such buildings can be quite expensive and would require major ventilation systems to expel truck exhaust gases and waste product vapor. Taxes, permits, inspections and fees for such a permanent dwelling also make buildings an unworkable solution. A fixed canopy reduces the cost and vapor handling requirements, but is ineffective in keeping even slightly wind-blown rain off of the transfer pad.

A less expensive known solution is to cover the pad with a standard tarpaulin fastened around the edges of the pad. The tarpaulin must be securely fastened to the ground to prevent it from blowing away in any strong wind, which makes it difficult for a truck operator to make use of the pad. He must first get out of the truck, remove the tarpaulin, usually by untying and then rolling it, and then get back in the truck to drive it onto the pad to begin the fluid transfer. When the transfer is complete, he must drive off the pad, get out of the truck, and cover the pad with the tarpaulin, which usually includes unrolling or unfolding it and tying it down in several places. Tarpaulins also tend to collect water and snow on their top surface, making them difficult to move.

OBJECTS OF THE INVENTION

It is thus an object of the invention to provide a transfer pad cover that is easily and quickly moved on and off the pad.

It is another object to provide a cover that can be moved laterally across an uneven transfer pad.

It is another object to provide a transfer pad cover that includes the benefits of a permanent building structure, without the financial and legal disadvantages of such a dwelling.

It is a further object to provide a cover that can withstand a full snow load and automatically indicates when the snow load has made it unsafe to move the cover. The cover is also designed to allow easy removal of the snow from the cover and to allow rain to run-off the cover by gravity.

It is a further object to provide a cover that is moved longitudinally, i.e., along the length of the pad, by a truck entering the pad, and returns to the pad automatically upon the truck's departure.

It is another object that the cover be able to withstand considerable wind gusts without blowing off of the pad.

It is yet another object to provide a cover that is lightweight, easy to manufacture and assemble, and relatively inexpensive.

SUMMARY OF THE INVENTION

In accordance with the objects of the invention, a transfer pad cover comprises a frame structure covered by a water-proof material. The frame structure is supported by bar joists that are mounted for movement along tracks. The entire structure is moved by hand or motor to a position adjacent the transfer pad during transfer. When the material and frame structure are weighted down, making it unsafe to move the cover, the joists will rest on a ground surface, preventing movement of the cover. In an alternate embodiment, the rails are sloped and the truck pushes the cover off of the pad. When the truck leaves the pad, the slope of the rails causes the cover to automatically return to its original covering position.

The foregoing and other objects and advantages of this invention will become apparent to those skilled in the art upon reading the detailed description of the preferred embodiments in conjunction with a review of the appended drawings.

DETAILED DESCRIPTION OF THE PREFERRED EMBODIMENTS

Figure 1:
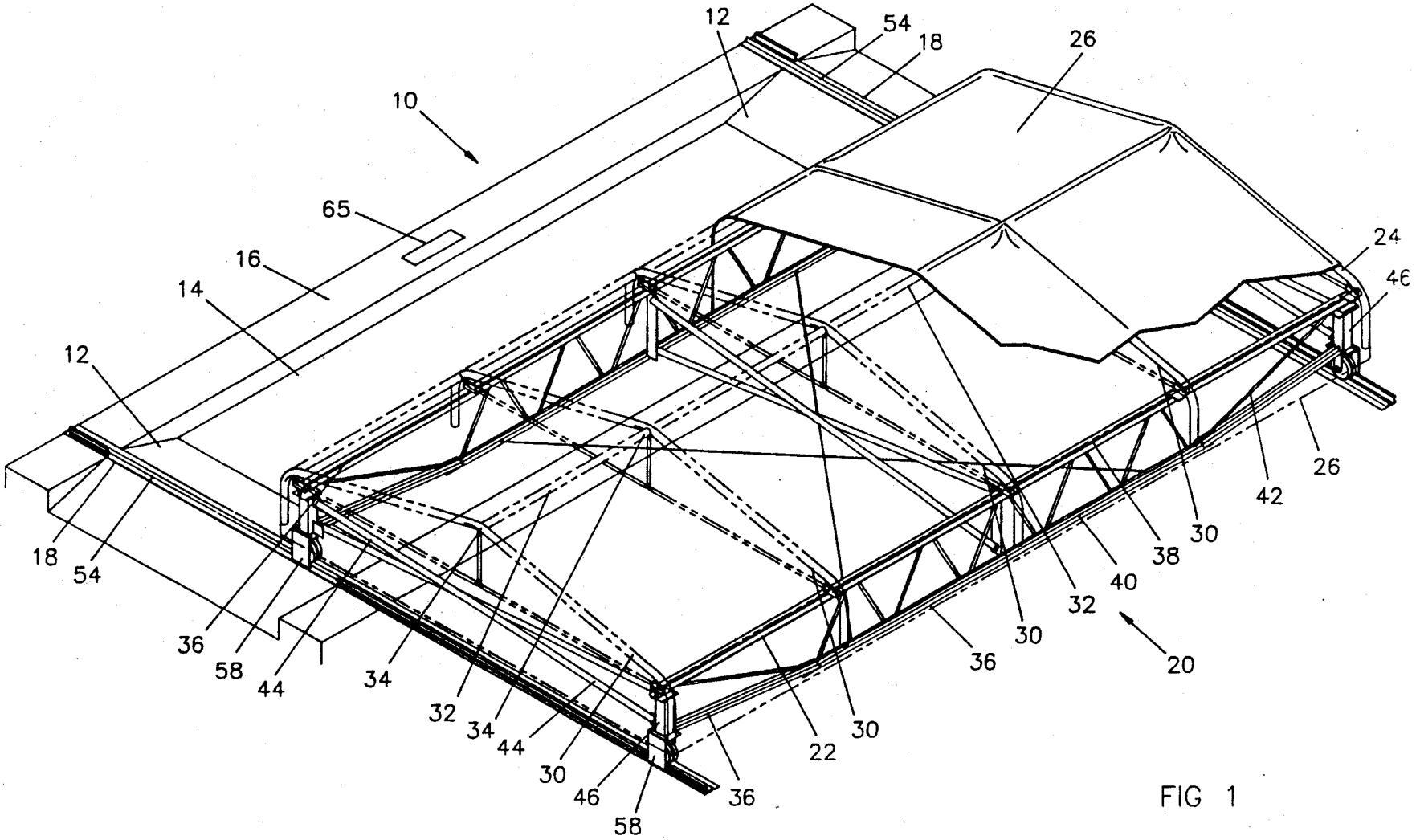
FIG. 1 is a perspective view of a transfer pad cover according to the invention, partially covering a pad.
Figure 2:
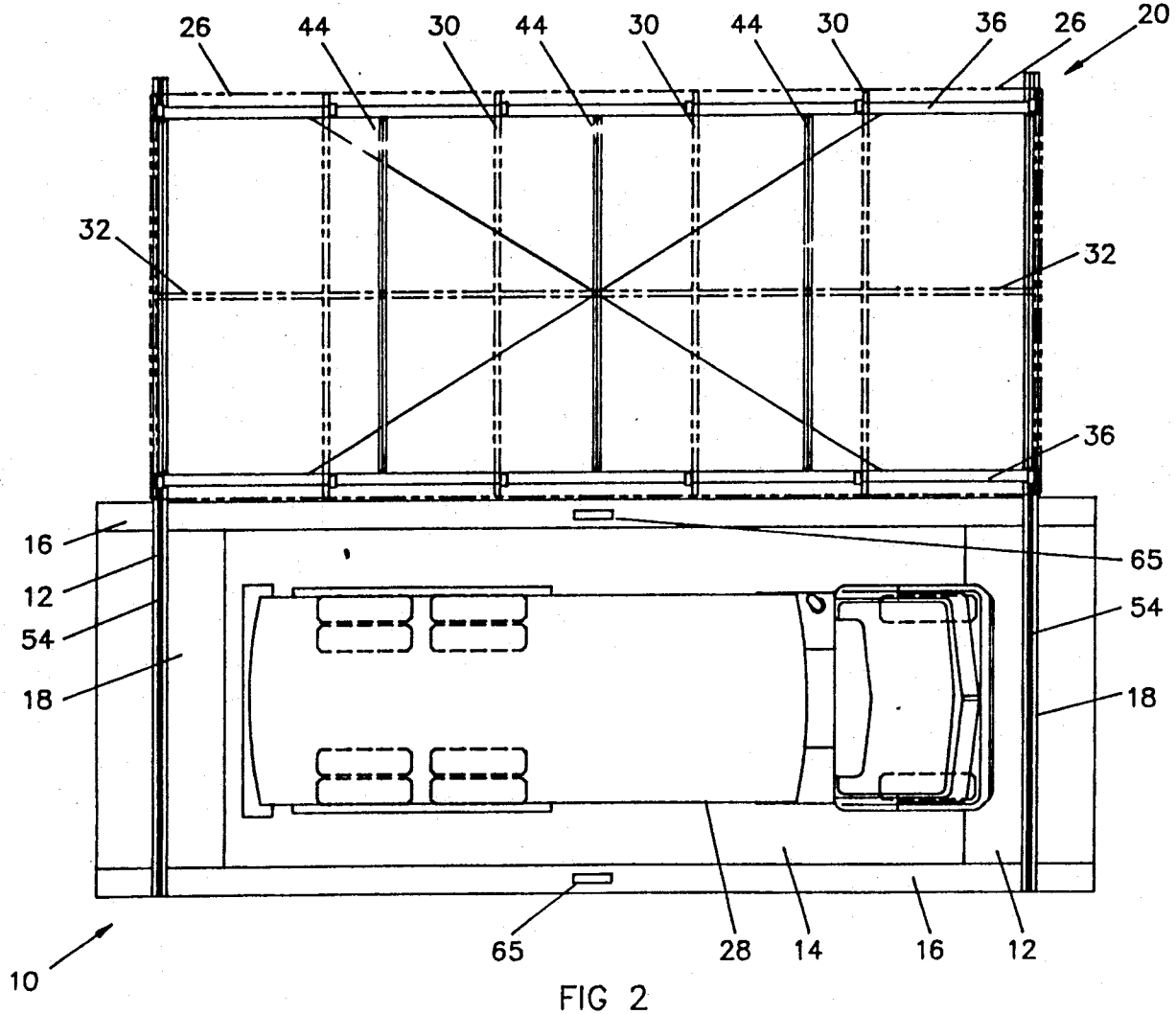
FIG. 2 is a top view of a transfer pad cover moved off the pad while a truck is in position on the pad.

Referring now to FIG. 1, a transfer pad 10 is shown, such as those used for transferring hazardous liquids, petroleum products or other regulated products. The uneven shape of the pad can be seen in the figure, specifically the sidewalls 12 and the basin 14. A deeper central sump (not shown) in the center of the basin 14 may also be present. The sidewalls 12 at the ends of the pad 10 are sloped to serve as ramps for a truck to enter and exit the recessed basin 14 of the pad 10. All on an even plane are two side skirt areas 16 and two end skirt areas 18. Partially covering the pad 10 is a transfer pad cover 20, which includes a support frame 22 and a cover frame 24 resting on top of and secured to the support frame 22. The cover frame 24 is preferably covered with a tarpaulin 26, made of a durable weather-resistant material, such as SHELTER-RITE 8028 polyester fabric, which is a fiber-reinforced, coated synthetic fabric. This tarpaulin 26 serves to protect the transfer pad 10 from precipitation when the cover 20 is in a first "pad-protect" position, fully covering the pad 10. The precipitation could otherwise collect on the pad 10 as contaminated stormwater requiring off-site disposal, or even overfill the pad 10 and carry waste liquids to surrounding areas. FIG. 2 shows a top view of the cover 20 moved to a second "pad-exposed" position, with a truck 28 in position for transferring liquid, dry powder or other similarly handled materials.

In a presently preferred embodiment, the cover frame 24 includes bent cross members 30 and central linking members 32. These members 30, 32 are preferably formed of tubular mild steel with an outside diameter of 1.9 inches and a wall thickness of 0.109 inches to reduce their weight while providing strength and stiffness. The cover frame 24 is preferably manufactured in an unassembled form by Rubb Inc., Sanford Municipal Airport, Sanford, Me., USA as part of the Rubb shelter product line. The cross members 30 preferably include a peak angle bend 34 at their midpoint to provide a slope to the tarpaulin 26, preventing water from accumulating and making the removal of any accumulated snow easier. Peak snow loads can reach about 20–90 pounds per square foot. Ice loads, such as those caused by cycles of melting and refreezing snow, are considered similar to snow loads for purposes of this application.

The ends of each of the cross members 30 overhangs the support frame 22 and prevents movement of the cover frame 24 in the direction of the cross members 30. The cover frame 24 is secured to the support frame 22 by any known method, such as bolts or rivets or welding.

The tarpaulin 26 is preferably attached to the cover frame 24 by lacing, tension springs, or elastic cords, although other methods, such as inserting the cross members 30 through sewn pockets, will work similarly, so long as the resulting tarpaulin 26 is taut and weatherproof over its entire surface. As will be described below, the tarpaulin 26 is not taut along its lowest portion, so a trivial amount of precipitation may enter under the cover 20 through the sides, but not enough for significant accumulation or over-spillage.

Of course, other variations of the cover frame are possible, such as different angle bends, different cross member configurations or other tarpaulin materials, provided the advantages of the preferred embodiments are met.

In the presently described embodiment, the main elements of the support frame 22 are two joist members 36 parallel to the longer sides of the pad 10. These joists 36 are constructed in a known fashion with top and bottom support bars 38, 40 and diagonal struts 42 connected between the bars 38, 40. The joists 36 are preferably manufactured according to the Steel Joist Institute's Open Web Steel Joist, K-series specification, although other joists and truss structures may be used similarly, so long as they perform similarly to the description of the joists 36 below. Connected to and between the two joists 36 are support cross members 44, also preferably formed of iron and of sufficient size and strength to maintain the integrity of the support frame 22 under heavy snow and winds loads, such as 2 inch schedule 40 iron pipe. Preferably, there are three sets of support cross members 44, each set consisting of two members 44 at a slight angle to each other. Other support cross member 44 configurations will work similarly. The strength of the joists may be varied, depending on potential maximum snow loads in the location of installation. In some climates, the snow loads are negligible, requiring minimum strengths of the joists 36.

Figure 3:
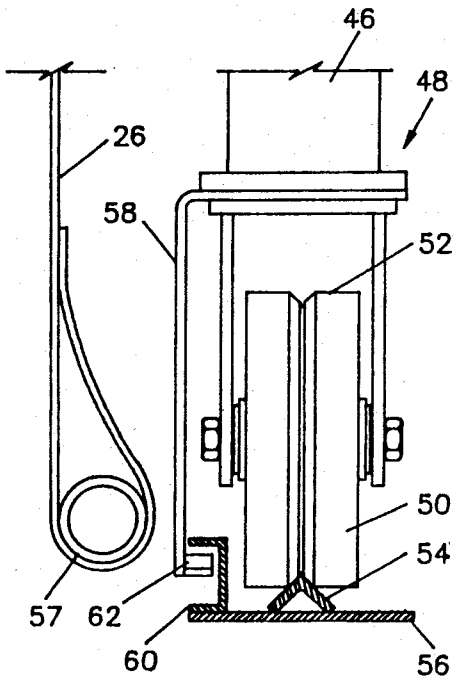
FIG. 3 is a detail front view of a wheel assembly and lift-stop mechanism for a transfer pad cover.

At each end of the joists 36 is preferably a vertical beam 46 that rests on and is secured to a wheel assembly 48, preferably such as that shown in FIG. 3. A wheel 50 having a circumferential groove 52 about its centerline rests on a track formed by an inverted angle iron 54 or similar track material to maintain directional stability of the cover 20 as it is moved on or off the pad. The angle irons 54 are mounted on track bases 56, which are preferably mounted on the end skirts 18 of the pad 10.

As can be seen in FIG. 3, the tarpaulin 26 preferably hangs to near the bottom of the wheel assembly 48, which is below the bottom of the cover frame 24, and also overhangs the outer edges of the pad 10. The bottom portion of the tarpaulin 26, i.e., the portion below the ends of the cross members 30 as in FIG. 1, hangs freely and is preferably biased to a vertical position by a weight 57, which may be a steel tube or rod. By having the tarpaulin 26 overhang the pad 10, only negligible precipitation will penetrate the basin covering scheme and get into the basin 14, perhaps aided by stiff winds.

Strong winds might also move the bottom portion of the tarpaulin 26 and allow wind to pass under and into the interior of the cover 20. Since the support frame 22 and cover frame 24 are relatively light, it might be expected that a stiff breeze or gust of wind could potentially move the cover 20 to the pad-exposed position or carry it off the tracks 54 altogether and away from the pad 10. To prevent the cover 20 from unwanted movement on the tracks 54, the cover 20 can be tied to anchors in its pad-protect position when not in use, or locked there in any known manner.

Preventing the cover 20 from completely blowing away poses a more difficult problem, as the cover 20 must be able to resist being lifted off the tracks 54 at many points along the tracks 54, including when it is in use and rolling on them. Thus, as part of the wheel assemblies 48, an angled stop arm 58 preferably extends from the wheel bracket downward and under an angle bracket 60 attached to the track base 56. Thus, if the cover 20 is lifted by a passing breeze, the inwardly projecting end 62 of the stop arm 58 will engage the underside of the angle bracket 60, preventing further upward movement of the cover 20. The dimensions of the arm 58 and bracket 60 are pre-determined so that at maximum upward displacement, the wheels 50 will not be completely above the peak of the angle irons 54 and will re-seat themselves automatically when the breeze has passed. It is contemplated that this lift-prevention feature could be designed in other ways, such as having the projecting end 62 and bracket 60 reversed or using more complicated wheel assemblies that are secured to the tracks 54. However, these are not preferred. The brackets 60 also preferably do not extend over a portion of the side skirts 18 when the track bases are surface mounted, thus avoiding damage to the brackets 60 from repeat truck overruns.

In the unloaded condition, the center of the bottom support bar 40 of the joists 36 will preferably be approximately 1.5 inches off of the side skirts 16 in this presently described embodiment of the invention, allowing the bar 40 to clear any minor variations in the surface of the pad 10 as it traverses the pad 10. If the pad is uneven at the area under the center of the joists 36, stop blocks 65 or shims can be secured to the pad under the joists 36 to make the distance between the pad 10 and the joists 36 approximately 1.5 inches.

As snow 66 falls onto the tarpaulin 26 and accumulates, the weight of the snow 66 will make it unsafe for a driver to move the cover 20 manually or to use any motor that might be driving the cover 20. The snow 66 might shift suddenly and fall onto and injure the driver or fall into the basin 14 of the pad 10, defeating a purpose of the cover 20. The tremendous weight of the snow 66 also increases the stress on the wheels 50 as the cover 20 moves and could damage any driving motor. To alleviate the load, the snow 66 can be swept off by a driver or other worker, aided by the sloped angle of the tarpaulin 26.

Figure 4:
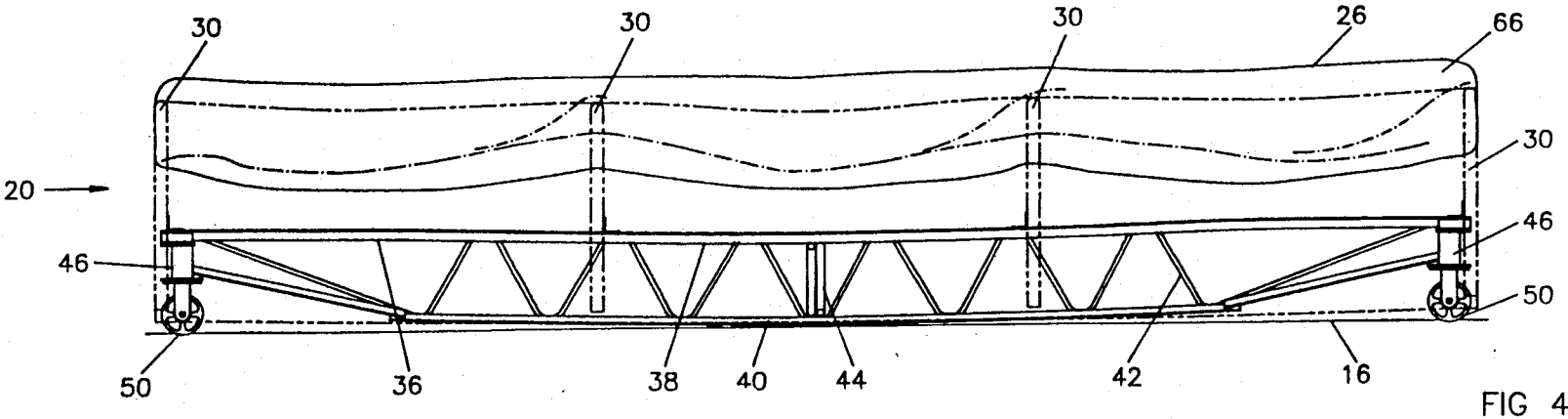
FIG. 4 is a side view of a transfer pad cover fully deflected due to a snow load.

However, to eliminate the driver's responsibility to make judgements about the snow load and to automatically indicate when the snow load is substantial and it is unsafe and improper to move the cover 20, the joists 36 are preferably designed to flex downward slightly under heavy snow loads greater than a predetermined critical load. In the preferred embodiment now being described, the vertical displacement or sag of the mid-section 64 of the joist 36 in response to the critical load is around 1/240th of the joist span, e.g., the above-mentioned 1.5 inches. As snow 66 accumulates, the joists 36 will gradually flex to a downward-bowed position. As more snow 66 accumulates past the critical load, which is preferably equivalent to a 6 inch-deep layer of wet snow and which makes moving the cover 20 unsafe, the joists 36 will have gradually deflected to the point where they rest on the pad 10 or on top of the stop blocks 65, as shown in FIG. 4.

In this position, the joists 36 are prevented from further deflection, which could be damaging to the joists 36 and support frame 22. The support and cover frames 22, 24 are preferably designed to withstand the local building code requirements for maximum snow load once the joists 36 are resting on the pad 10. The weight bearing on the cover 20 and the joists 36 as they rest on the skirts 16 of the pad 10 will also create a frictional force between the joists 36 and the pad that will be large enough that moving the cover 20 manually becomes nearly impossible. Should a driver or other worker not realize the heavy snow load or not see the joists 36 resting on the pad 10, the tremendous effort he will need to exert in attempting to move the cover 20 or failure of a motor to accomplish the task will automatically and immediately alert the driver to the excessive snow load.

Upon removing the snow 66 by brushing or other methods, the joists 36 will return to their level position. It will then again be possible for the driver to manually move the cover 20 off the pad 10.

The absence of supporting structures under the mid-length of the joists 36 not only provides for the prevention of movement in unsafe conditions discussed above, but also makes it possible to move the cover 20 laterally with respect to the pad 10. This is preferred since a truck 28 drives onto the pad 10 from one end and then continues forward, after transferring liquid, to drive off the opposite end of the pad 10. To compensate for the uneven longitudinal cross-section of the pad 10, formed by the sidewalls 12 and basin 14, would require quite complex and vertically adjusting support wheels. If tracks to support these complex wheels were set into the basin 14, they would quickly become fouled and difficult to use from being often submerged in thick and corrosive liquids. In the preferred embodiment, the long joists 36 only require tracks 54 that are embedded in the level end skirts 18 of the pad 10.

Except for the minimal areas at the bottom of the tarpaulin 26 where wind can enter, there is no entrance to the interior of the cover 20, making it unusable as a shelter for workers or drivers. The preferred maximum height of only three feet also makes the cover 20 non-functional as a dwelling. Advantageously, the cover 20 thus does not qualify as a structure according to many building or fire codes and will not be subject to the strict inspection and construction regulations or the significant tax burden normally associated with dwellings, even of the temporary type.

Figure 5:
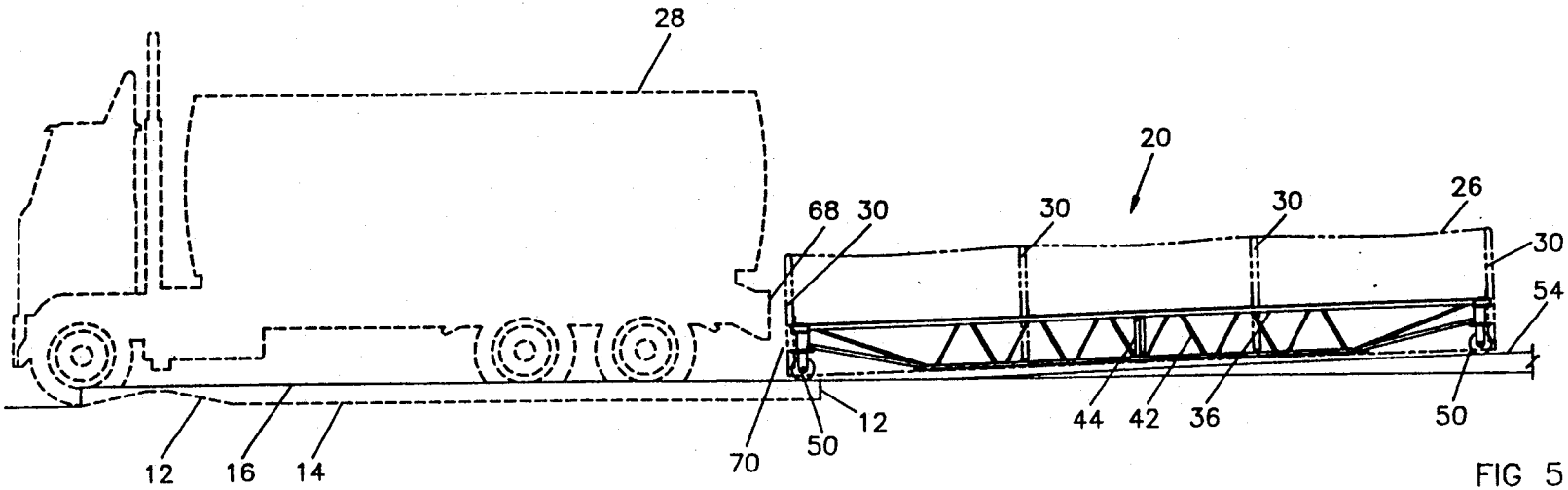
FIG. 5 is a side view of an alternate embodiment of the transfer pad cover of the invention.

In an alternate embodiment, shown in FIG. 5, trucks 28 will enter and exit the pad 10 from the same end, making longitudinal, rather than lateral, movement of the cover 20 a possibility. In this embodiment, the structure of the support and cover frames 22, 24 and tarpaulin 26 is identical, except that the wheels 50 have been rotated 90° while respect to the vertical. The tracks 54 are also now laid longitudinally to the pad 10 and embedded in the level side skirts 16. When the truck 28 backs onto the pad 10, the rear bumper 68 of the truck 28 will abut the end support cross members 44 or the vertical beams 46 and push the cover 20 along the tracks 54 to a pad-exposed position adjacent an end skirt 18 of the pad 10, as shown in FIG. 5.

It can also be seen that the portion of the tracks 54 that is off the pad 10 is preferably sloped slightly upward as it leaves the pad 10, at an angle of about 1°–2°. First, this will prevent the truck 28 from pushing the cover 20 with too much force and having it glide freely off the end of the tracks 54, regardless of whether there is a stop mechanism at the end of the tracks 54. Second, the cover 20 will be biased by the slope against the truck bumper 68 and will thus automatically return to its original pad-protect position as the truck 28 exits the basin.

This embodiment makes it possible for the driver to move his truck 28 onto the pad 10, transfer the liquid, and drive away without having to leave the truck cab to move the cover 20 either off or back onto the pad 10. No motors for the cover of this embodiment are necessary, thus saving equipment, operation and maintenance costs. To protect the end of the cover 20 from damage, it is contemplated that a bumper 70 is applied to the end of the cover 20 to abut the bumper 68 of the truck 28.

Alternatively, either in place of or in addition to the gravity-driven sloped rails returning the cover 20 to its pad-protect position, a spring and pulley system could be installed between the cover 20 and the pad 10 to bias the cover 20 to its pad-protect position.

It can thus be seen that a cover 20 is provided for an uneven transfer pad 10 that is easy to move between a pad-protect and pad-exposed position. Preferably, lateral movement of the cover 20 is possible due to the joists 36 being supported only at each end. The end-suspended joists 36 also automatically make the cover 20 nearly impossible to move in dangerous snow load conditions by sagging downwardly to and frictionally abutting the pad surface.

While the embodiment of the invention shown and described is fully capable of achieving the results desired, it is to be understood that this embodiment has been shown and described for purposes of illustration only and not for purposes of limitation.

What is claimed is:

1. A cover for protecting a transfer pad from precipitation, said transfer pad having an raised perimeter, said cover comprising:

a movable cover portion having a water-proof sheet material secured thereto, said movable cover portion extending substantially over the entire surface of said pad when the cover portion is in a first position;

a support portion positioned below said cover portion and supporting said cover portion, said support portion having longitudinal ends and a midsection;

level tracks mounted on said pad and extending to an area adjacent to said pad, said tracks positioned under said longitudinal ends of said support portion, said support portion being movably engaged to said tracks only at said longitudinal ends, said midsection of said support portion being entirely raised above said raised perimeter, whereby said cover may be moved laterally between said pad and said area adjacent said pad without engaging said pad.

2. A cover according to claim 1, wherein said support portion has a stiffness such that said midsection will sag a first predetermined distance and frictionally engage said pad in response to a predetermined load on said sheet material such that said cover will substantially resist lateral movement.

3. A cover according to claim 2, further comprising stop blocks mounted on said pad under said midsection of said support frame such that the distance between said midsection and said stop blocks equals said first predetermined distance when said cover portion is unloaded.

4. A cover according to claim 3, further comprising wheel assemblies mounted on said support portion and riding on said track means, said track means including means for preventing upward movement of said wheel assemblies greater than a second predetermined distance.

5. A cover according to claim 4 wherein said sheet material overhangs the perimeter of said pad and extends to a position adjacent to said wheel assemblies.

6. A cover for protecting a transfer pad from precipitation, said pad having a raised perimeter, said cover comprising:

a cover portion having a water-proof sheet material secured thereto, said cover portion extending substantially over the entire surface of said pad when said cover portion is in a first position;

a support portion having a midsection, said support portion positioned below said cover portion and supporting said cover portion, said support portion being movably mounted on said pad such that said midsection is initially suspended above said pad, said midsection being adapted to sag a predetermined distance and frictionally engage said pad in response to a predetermined load on said cover portion.

7. A cover according to claim 6, further comprising stop blocks mounted on said pad under said midsection of said support frame such that the distance between said midsection and said stop blocks equals said first predetermined distance when said cover portion is unloaded.

8. A cover according to claim 7, further comprising tracks mounted on said pad and extending to an area adjacent said pad, said support portion having longitudinal ends and further comprising wheel assemblies at said longitudinal ends, said wheel assemblies riding on said tracks, said tracks including means for preventing upward movement of said wheel assemblies greater than a second predetermined distance.

9. A cover according to claim 8 wherein said sheet material overhangs the perimeter of said pad and extends to a position adjacent to said wheel assemblies.

10. A cover for protecting a transfer pad from precipitation, said pad adapted to accommodate vehicles thereon, said pad having a raised perimeter, comprising:

a cover portion having a water-proof sheet material secured thereto, said cover portion extending substantially over the entire surface of said pad when said cover portion is in a first position;

tracks for movably supporting said cover portion, said tracks having a first portion and a second portion, said first portion being level and mounted on said pad, said second portion being contiguous with said first portion and mounted on an area longitudinally adjacent said pad, whereby when said vehicle moves onto said pad and abuts said cover portion, said cover portion will be moved along said track means from said first portion to said second portion.

11. A cover according to claim 10 wherein said second portion is angled upward with respect to said first portion, whereby when said vehicle moves off of said pad, said cover will move by gravity from said second portion to said first portion.

12. A cover according to claim 11 wherein said cover portion further comprises a support portion having a midsection initially suspended above said pad, said midsection being adapted to sag a first predetermined distance and frictionally engage said pad in response to a predetermined load on said cover portion.

13. A cover according to claim 12 wherein said support portion further comprises wheel assemblies mounted on said tracks, said tracks further comprising means for preventing upward movement of said wheel assemblies greater than a second predetermined distance.

14. A cover according to claim 12 further comprising stop blocks mounted to said pad under said midsection when said cover is on said first portion, said stop blocks dimensioned such that said distance between said midsection and said stop blocks equals said first predetermined distance when said cover portion is unloaded.

15. A cover according to claim 10 further comprising means for biasing said cover portion, said means for biasing connected to said cover portion such that when said vehicle moves off of said paid, said cover will be moved by said means fir biasing from said second portion to said first portion.

* * * * *